United States Patent [19]

Bordet

[11] Patent Number: 4,520,600

[45] Date of Patent: Jun. 4, 1985

[54] STACKS OR VERTICAL PIPES FOR THE FLOW OF GAS

[75] Inventor: René Bordet, Courbevoie, France

[73] Assignee: Electricite de France (Service National), Paris, France

[21] Appl. No.: 234,435

[22] Filed: Feb. 13, 1981

[30] Foreign Application Priority Data

Feb. 18, 1980 [FR] France ..... 80 03484

[51] Int. Cl.[3] ..... E04B 7/14

[52] U.S. Cl. ..... 52/83; 52/222; 52/245; 52/146; 261/DIG. 11

[58] Field of Search ..... 52/80, 81, 83, 222, 52/73, 120, 247, 245, 146, 23, 63, 82, 152; 261/DIG. 11

[56] References Cited

U.S. PATENT DOCUMENTS 3,994,108 11/1976 Johnson ..... 52/83

4,326,363 4/1982 Leonhardt et al. ..... 52/83

FOREIGN PATENT DOCUMENTS 2154967 5/1973 Fed. Rep. of Germany ..... 52/83

2325290 9/1973 France .

*Primary Examiner*—John E. Murtagh

*Assistant Examiner*—Kathryn L. Ford

*Attorney, Agent, or Firm*—Fleit, Jacobson, Cohn & Price

[57] ABSTRACT

The present invention relates to a stack or a vertical pipe for the flow of gas, said stack or pipe comprising a suspension mast defining a vertical axis; at least one supple surface, open downwardly and upwardly, and symmetrical with respect to this axis; substantially horizontal, rigid hoops, viz. an upper hoop and a lower hoop respectively fast with the upper and lower periphery of the surface, each hoop being symmetrical with respect to said axis; supple bearing ties suspending the upper hoop from the mast; and stays connecting the lower hoop to a fixed lower point of the mast or the ground to stretch the supple surface in a vertical direction. The invention finds application in the entire production or extension of stacks or pipes such as atmospheric cooling towers.

21 Claims, 5 Drawing Figures

FIG_1
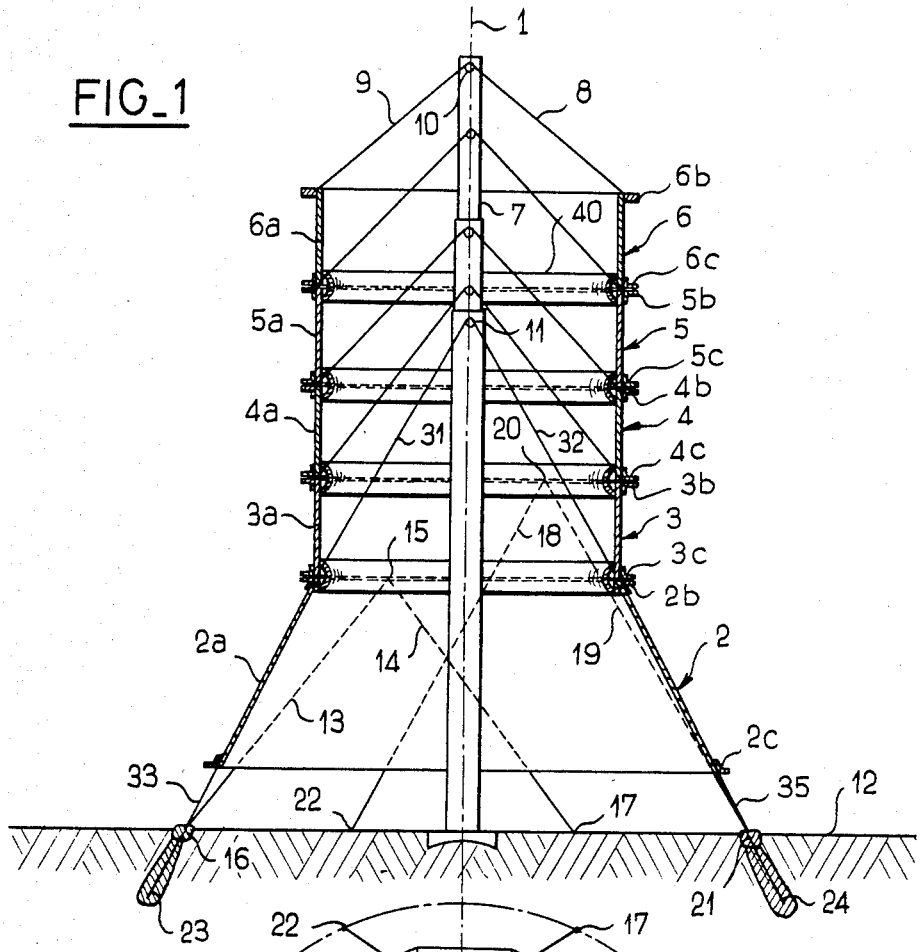
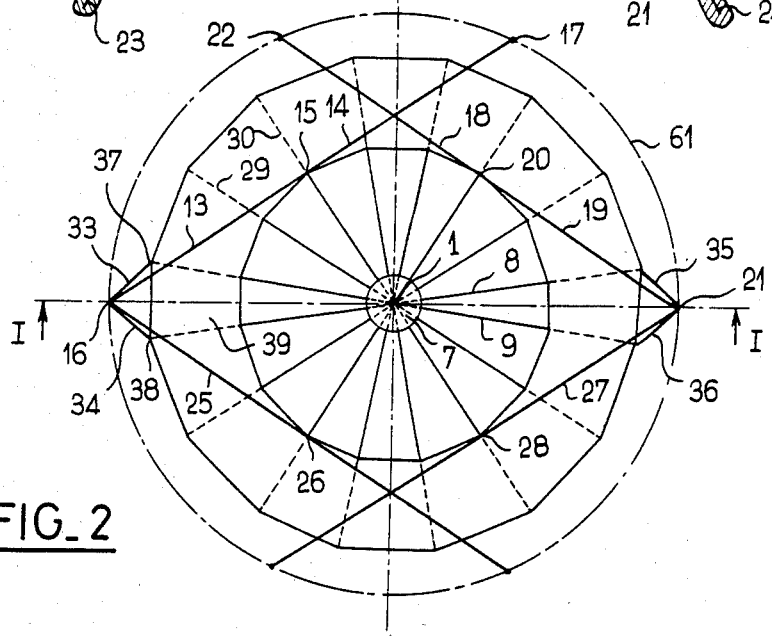
FIG_2

FIG_3
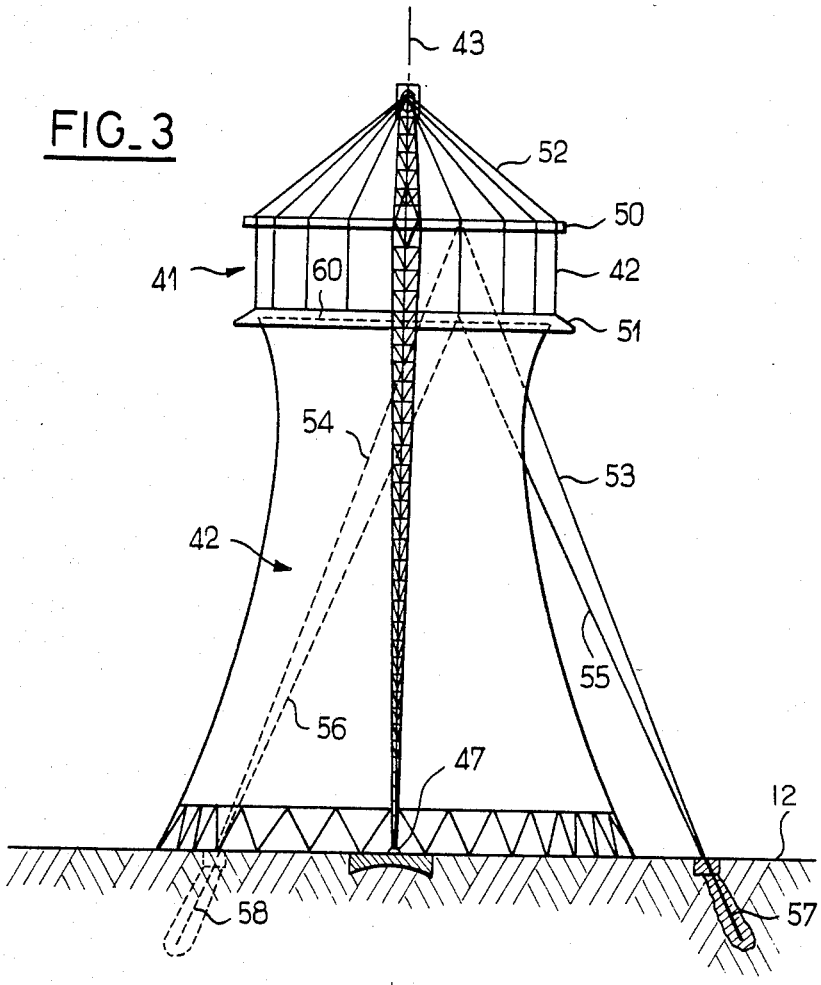
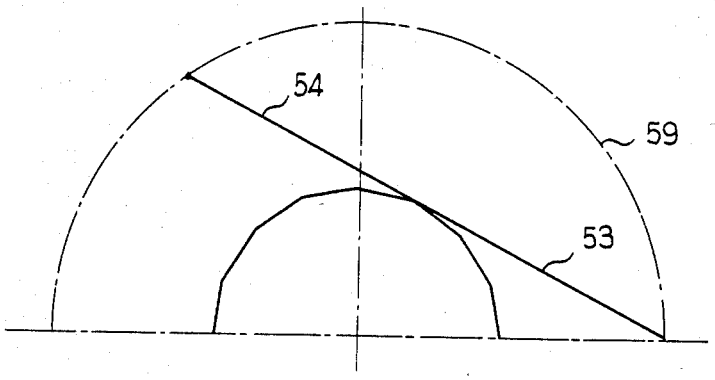
FIG_5

STACKS OR VERTICAL PIPES FOR THE FLOW OF GAS

The present invention relates to stacks or vertical pipes for the flow of gas, and more particularly, but not exclusively, to the construction of atmospheric cooling towers of all types.

The largest of these towers are presently constructed for the atmospheric cooling of high-power generating stations, and are generally composed of reinforced concrete shells in the form of hyperboloid of revolution about a vertical axis.

In this known technique, the rigidity of the shells is essentially sought, and although satisfaction is obtained for presently constructed towers, the extrapolation of the dimensions beyond those of these towers, for example with a view to equipping generating stations of higher power, particularly nuclear power stations, raises problems of safety due to a lack of knowledge of, means for experimenting and means for calculating the different phenomena involved in this safety and in particular the phenomenon of buckling of the shell; this problem has not yet been solved.

The present invention is the result of a diametrically opposite line of research, since, instead of seeking rigidity, I have, on the contrary, opted for suppleness, for considerable deformations; in other words, I have not sought to oppose buckling or blistering of the tower, but have sought to render this phenomenon acceptable by translating in acceptable manner the efforts that it may create.

To this end, the invention proposes an atmospheric cooling tower, or more generally any stack or any vertical pipe for the flow of gas, in the form of a superposition of sections of conduit having any surface of revolution or substantially of revolution such as prism, cylinder, frustum of pyramid or of cone, hyperboloid, torus, etc . . . , supported and balanced in space partially or totally independently of one another, and of which each is made of a light, supple material, such as cloth, stretched between two circular or polygonal hoops; each conduit is suspended in the air by supple bearing ties fixed to the upper hoop, and which transfer the weight and the vertical component of the surface tension efforts on a central, vertical mast, or on a support of a lateral mast, via pulleys suspended from the mast or from the support, or via a slide system of reduced coefficient of friction making it possible to transmit to the mast or to the support respectively, only negligible horizontal efforts; the different conduits are, furthermore, stretched by stays, connecting the lower hoop to the ground; part of this tension may possibly advantageously be transferred by ties on the central mast at a level lower than that of the hoop. Such stays may, furthermore, also be provided to connect the upper hoop to the ground, and their position is judiciously chosen to balance the corresponding conduit in rotation on itself.

Thus, when the action of the wind deforms the cloth on one side or the other of the position of equilibrium defined by the position in which the stays corresponding to the same hoop are subjected to an identical tension, an additional tension appears in the cloth which is transmitted to the two hoops, and from there, to the ground directly, by the stays, and indirectly, by the bearing ties and the mast as far as the vertical component of this excess tension is concerned; in addition, the conduit may then move laterally, possibly differently at upper hoop level and at lower hoop level, by an additional tensioning of the bearing ties and the stays, independently of the other conduits.

In other words, the buckling, then authorised, of the tower, the stack, or the conduit formed by the superposition of the different independent conduits, is entirely transferred to the ground, in tensile stress at the level of the stays and in vertical thrust at mast level, conduit by conduit, and in no case produces in the walls stresses similar to those which would appear in a rigid wall.

Apart from finding application in the construction of stacks or vertical pipes such as atmospheric cooling towers in their entirety, the invention may also be applied to the extension of pre-existing rigid stacks or vertical pipes, either with a view to improving their performances, or with a view to making repairs after their top part has been made level; a supple conduit suspended between a mast, via bearing ties, and the ground, via stays, in the manner described hereinabove, or a plurality of superposed supple conduits thus stretched independently, may then be superposed on the top part of the pre-existing edifice, in line therewith.

According to the invention, the stack or vertical pipe for the flow of gas, such as an atmospheric cooling tower, of the type comprising:

a suspension mast defining a vertical suspension axis, a plurality of supple surfaces, open downwardly and upwardly, symmetrical with respect to this vertical axis, superposed vertically, rigid, substantially horizontal hoops, viz. an upper hoop fast with the upper periphery of each surface and a lower hoop fast with the lower periphery of this surface, each hoop being symmetrical with respect to said vertical axis, supple bearing ties suspending each upper hoop from the mast, stays for connecting the hoops with one or more fixed points with respect to the ground and located at a level lower than that of the corresponding hoop, wherein the lower hoop of an upper surface is adjacent to but independent of the upper hoop of a surface located immediately therebeneath, these two hoops having similar shapes and dimensions in a horizontal plane, the lower hoops are not provided with bearing ties for suspension to the mast, two adjacent upper and lower hoops are adapted to undergo relative movement, and stays connect each lower hoop to one or more fixed points with respect to the ground located at a level lower than that of said hoop, to stretch each supple surface between the corresponding upper and lower hoops, independently of the other supple surfaces.

According to a further feature, a bearing tie connects two diametrically opposite zones of the corresponding hoop, and is suspended from the mast between these two zones, at the level of said vertical axis, via means guiding it in translation on itself.

The invention will be more readily understood on reading the following description with reference to the accompanying drawings, in which:

FIG. 1 shows a view of an atmospheric cooling tower entirely constituted by the superposition of independent supple conduits, according to the invention, in section through a vertical axial plane such as plane I—I of FIG. 2.

FIG. 2 shows a plan view of this tower.

FIGS. 3 and 4 show a rigid atmospheric cooling tower provided with an extension according to the invention, in two side elevations.

FIG. 5 shows a half plan view of this tower.

Figure 4:
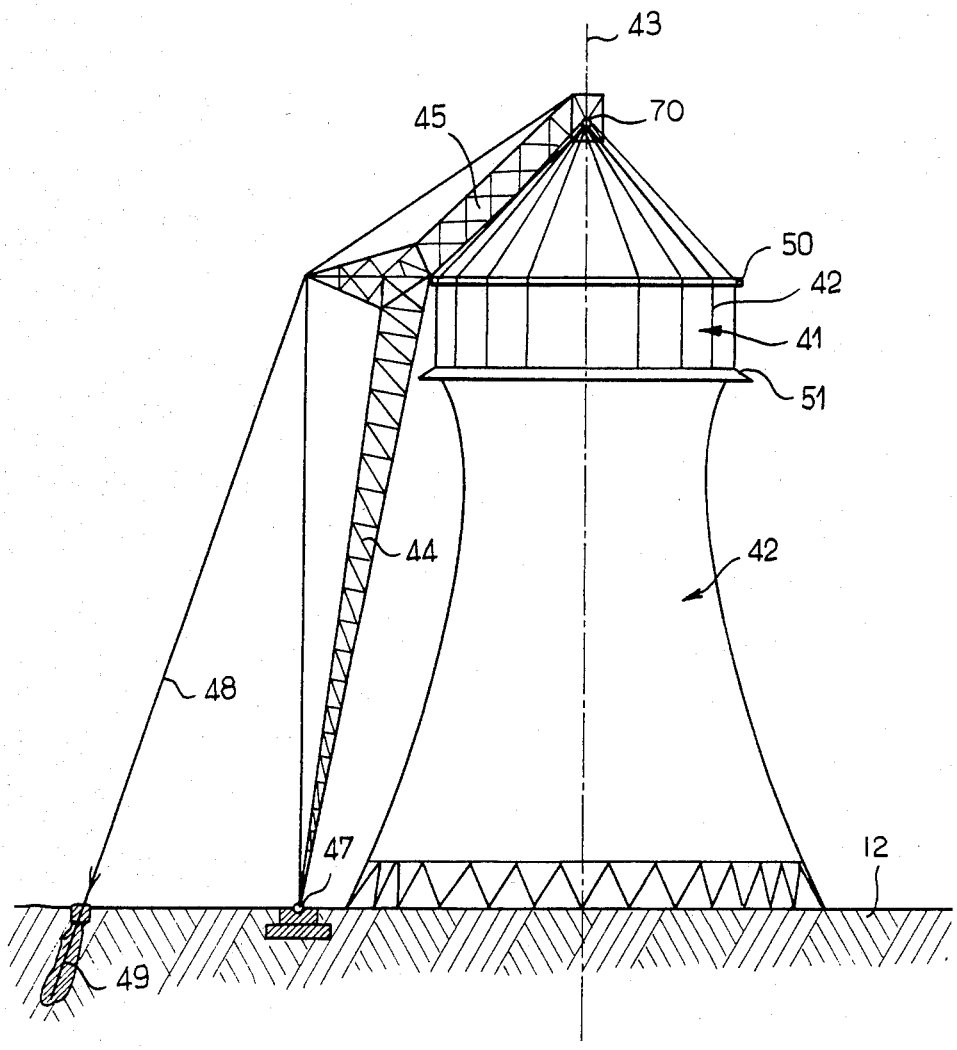

For greater clarity, these Figures are in schematic form, particularly at the connection of the bearing ties and the stays with the other elements, and only certain of these bearing ties and stays have been shown, in view of the fact that it is within the knowledge of the man skilled in the art to effect these connections and to provide the bearing ties and stays in appropriate number and arrangement.

Reference will firstly be made to FIGS. 1 and 2, which show a symmetrical tower with respect to a vertical axis 1, and formed by the superposition and connection, end to end, of five sections 2 to 6 respectively, from bottom to top, each of which is symmetrical with respect to the axis 1 and defined by a lateral wall whose section through a horizontal plane is in the form of a regular polygon, for example with sixteen sides, this number being given by way of non-limiting example and preferably being as large as possible so that the tower presents a form which is as close as possible to a shape of revolution about the axis 1.

According to the invention, the wall of each of the conduits 2 to 6, 2*a* to 6*a* respectively, is made of cloth or another light, supple material, and presents substantially flat, horizontal upper and lower peripheries, when the tower is assembled. Said upper periphery and lower periphery, which are entirely open, are bordered in fast manner by rigid horizontal hoops, constituted for example by beam elements in lattice form, viz. an upper hoop 2*b* to 6*b* respectively, and a lower hoop 2*c* to 6*c* respectively, each of which presents the form in plan which it is desired to give the supple wall at the corresponding level.

The walls are connected to the corresponding hoops by lacing, welding or sewing, for example, if the material of the wall lends itself thereto; according to the quality of the material used, its tension may be eased by supple connections such as flexible pieces or ties, between hoops, by intermediate hoops or by the two means combined; each wall may itself advantageously be constituted by a plurality of assembled panels, each of which presents an upper edge and a lower edge respectively fast with the upper hoop and the lower hoop, and two lateral edges of which each is assembled on the immediately adjacent, similar lateral edge of a similar panel, at the level of the edges of the wall; this assembly may also be made, for example by lacing, welding or sewing if the materials lend themselves to this, but other modes of connecting the panels together and to the hoops may, of course, be chosen without departing from the scope of the invention; however, a removable connection will be preferred, which facilitates assembly and re-assembly in case of damage, on surface with double curvature by assembling flat triangular surfaces for example welded or sewn or both welded and sewn.

In the example illustrated in FIGS. 1 and 2, each of the conduits 2 to 6 is carried, independently of the other conduits, by a central vertical mast 7 of axis 1; this central mast 7 may be in different forms, such as for example that of a metal lattice or a reinforced concrete stack, but other embodiments may, of course, be chosen; the height of the mast 7 is greater than the accumulated height of the conduits 2 to 6 insofar as its top end must be located at a level higher than that of the upper hoop 6*b* of the top conduit 6 when the tower is assembled.

The suspension of the top hoop of each of the conduits 2 to 6 from the mast 7 is ensured by supple bearing ties or suspending lines, of which each preferably connects two zones of the corresponding hoop which are diametrically opposite with respect to the axis 1 and rests in a median zone on appropriate bearing means such as 10 and 11 of the mast 7; these bearing means are preferably chosen so as to ensure a guiding of the tie in translation on itself, preventing it from moving vertically, so that, under the action of the wind acting on the wall of the elementary conduit in question, the upper hoop thereof, like the whole of this conduit, may become offset with respect to the axis 1, transmitting a minimum of horizontal efforts to the mast 7; to this end, the bearing means provided on this mast 7 for the bearing ties are for example constituted by pulleys, or slides coated with a material presenting a very low coefficient of friction, such as polytetrafluoroethylene.

Each bearing tie preferably connects two diametrically opposite apices of the hoop, as is the case of the two bearing ties 8 and 9 of the upper hoop 6*b* of the top conduit 6, a bearing tie preferably being associated with each set of two diametrically opposite apices of the hoop; more generally, the bearing ties of a hoop are preferably regularly distributed around the axis 1.

The tensioning of the supple wall of each conduit and in addition, its immobilisation in rotation about the axis 1, is ensured by connection of the corresponding lower hoop, and preferably of the upper hoop likewise, as far as the immobilisation in rotation is concerned, with the ground 12 via stays.

These stays are preferably grouped in sets of two stays fixed at the same point of the corresponding hoop, preferably at an apex thereof when it is polygonal in form, the two stays of the same set being located in the same vertical plane tangential to the hoop assimilated to its escribed circle, and oriented in this plane along two straight lines of a virtual vertical hyperboloid of axis 1, of which the hoop in question, assimilated to its escribed circle, would constitute a horizontal plane section.

In the case of the height of the structure being relatively short, therefore with low tendency of a conduit to rotate on itself, the stays may be radial, i.e. located in a vertical plane passing through axis 1.

In this case, the stays of the upper hoop of each conduit may also be eliminated.

Only some of these stays have been shown, and such sets of stays, regularly distributed about the axis 1, are preferably provided to connect each of the apices of each hoop with the ground 12.

One set of two stays 13 and 14 has thus been shown, connecting the same apex 15 of the lower hoop 3*c* of the conduit 3 to two points 16 and 17 respectively, of the ground, and two stays 18 and 19 connecting the same apex 20 of the upper hoop 3*b* of this conduit 3 of two points 21 and 22 respectively, of the ground.

All the anchoring points such as 16, 17, 21, 22 are constituted by blocks of concrete which are independent or connected in the same common annular block disposed in a ring 61, which solution is preferred for large structures, in that it distributes better the balancing efforts to the tension of the stays. Tie rods anchored in the ground, such as 23 for stay 13 and 24 for stay 19 may be added to these blocks to associate the weight of a large volume of ground with the balancing of the tension of the stays.

It will be noted that the same tie rod advantageously ensures anchoring of a plurality of stays; thus, in the example illustrated, block 23 receives, in addition to stay 13, the stay 25 symmetrical to this stay 13 with respect to a vertical plane including axis 1 and point 16, as well as these stays for connection with the apices of the hoops 3*b*, 4*c*, 4*b*, 5*c*, 6*c*, 6*b* located vertically plumb, respectively, with point 15 and point 26 at the level of which the stay 25 is connected to the hoop 3*c*, conduits 3 to 6 presenting identical transverse dimensions, in the same way as the dimensions in plan of their upper and lower hoops are identical.

Similarly, at point 21, the block 24 receives, in addition to the stay 19, a stay 27 connecting point 21 to the apex 28 of the hoop 3*b* located symmetrically to point 20 with respect to a vertical plane including axis 1 and point 21, as well as the stays placed in the same vertical plane respectively as the stay 19 and stay 27 and connecting the point 21 to the respective apices of the hoops 3*c*, 4*c*, 4*b*, 5*c*, 5*b*, 6*c*, 6*b* located respectively vertically plumb with the apex 20 and vertically plumb with the apex 28 of the hoop 3*b*.

Stays may further connect each lower hoop to any point, fixed to the mast 7, located at a level lower than that of said hoop (not shown).

It will be noted that, in the example illustrated, the lower conduit 2 does not have a constant transverse section over its whole height like conduits 3 to 6, but is in the form of an upwardly converging frustum of pyramid; its upper hoop 2*b* presents a shape and dimensions in plane similar to those of the upper and lower hoops of conduits 3 to 6, but its lower hoop 2*c* has greater dimensions in plan, with, however, similar polygonal shape and the same number of sides of which each is parallel to one of the sides of the other hoops; the supple wall of this conduit 2 is, for example, formed by assembling identical supple panels, each of which is in the form of an isosceles trapezium of which the small base is assembled with the hoop 2*b*, the large base with the hoop 2*c* and of which the sides are assembled in two's along edges such as 29 and 30 of the wall 2.

The upper hoop 2*b* is suspended from a point 11 of the mast 7 via ties 31 and 32, each of which, like the ties corresponding to the respective upper hoops of the different conduits 3 to 6, is preferably disposed so as to connect two apices of the hoop disposed symmetrically with respect to each other with respect to the axis 1 and to slide or roll freely at point 11 level; like the hoops of conduits 3 to 6, the hoops 2*b l and 2c* are furthermore connected to the ground by stays, as shown at 33, 34, 35, 36, the two stays 33 and 34 connecting to point 16 two apices of the hoop 2*c* corresponding here to the ends of the same side thereof, symmetrical with respect to the vertical plane included in the axis 1 and point 16; similarly, the stays 35 and 36 connected to point 21 the two ends of the side of the hoop 2*c* intersecting the vertical plane including the axis 1 and point 21 and disposed symmetrically with respect to this plane.

As illustrated, the point 11 is preferably chosen on the mast 7 at such a level that the ties of the hoop 2*b* extend the edges such as 29 and 30 of the wall of the conduit 2; in other words, referring to the example illustrated, the stays 33 and 34, the panel 39 of the wall 2*a* of which the large base coincides with the side of the hoop 2*c* at the ends of which they are connected, and the sections of the ties 31 and 32 located respectively between the apices of the hoop 2*b* corresponding to the ends of the side thereof contiguous with the small base of the trapezoidal panel 39 and point 11, are coplanar.

A tower may of course be made by superposing conduits such as 2 and 6 presenting shapes different from those which have been described and illustrated, particularly to give the tower a form as close as possible to that of a hyperboloid of revolution about axis 1, i.e. a form converging then diverging upwardly.

The tightness between two conduits, i.e. between the lower edge of an upper conduit and the upper edge of the conduit located immediately therebeneath, respectively, is ensured by ample, supple joints such as 40, authorising a free relative movement of the conduits, which is sought, according to the invention; in complement to the staying, a mechanical connection may possibly be provided, between the lower hoop of an upper conduit and the upper hoop of a lower conduit, to prevent relative rotation of the conduits, so as to allow a movement in vertical planes including the axis 1, prohibiting a relative movement of rotation about this axis 1; to this end, a connection between adjacent upper and lower hoops may for example be constituted by vertical slides (not shown).

The lightness and easiness of construction of a tower of the type illustrated in FIGS. 1 and 2 will be noted, which, after construction of the mast 7 and casting of the ground-anchoring blocks with the tie rods such as 23 and 24, may be made by assembly on the ground then successively raising the different conduits to their final position, beginning by the upper conduit 6 and continuing with the different conduits in the order in which they are presented from top to bottom in the tower, the balancing of each conduit, i.e. the tensioning of the corresponding stays, may advantageously be carried out when this conduit is placed in position, in view of the fact that the different conduits are independent; the upper and lower hoops of the different conduits may advantageously be made in a plurality of sections, which are assembled on the ground, around the mast, when the tower is being constructed.

It will further be noted that the tower thus constructed may be of any height, the number of conduits constituting it being chosen accordingly, taking into account the fact that the optimum height of a conduit is of the order of 30 to 50 meters for reasons of ease of assembly on the ground, then of raising, possible repair, and in view of the corresponding section of the cables advantageously used as ties and stays; however, this figure is given only by way of non-limiting example; likewise by way of non-limiting example, the tower illustrated in FIGS. 1 and 2 has a useful height of 200 meters with respect to the ground for a mast height of 240 meters, the hoop 2*c* being located at a height of 20 meters, hoops 2*b* and 3*c* at a height of 80 meters, hoops 3*b* and 4*c* at a height of 110 meters, hoops 4*b* and 5*c* at a height of 140 meters, hoops 5*b* and 6*c* at a height of 170 meters, and hoop 6*c* defining the top edge of the tower at a height of 200 meters.

FIGS. 3 and 4 illustrate a mixed construction according to which a supple conduit 41, in all points similar to one of conduits 3 to 6 of the example of FIGS. 1 and 2, is superposed, by way of extension, on the top part of a cooling tower 42 of known rigid type, for example made of reinforced concrete; a plurality of identical or different conduits 41 may, of course, be superposed in this way, in order to extend the tower by the desired height, with a desired shape.

As in the example of FIGS. 1 and 2, a central mast may be used for the suspension of the conduit 41, which is disposed in the vertical axis 43 of the tower 42, but another embodiment of the mast has been illustrated, which might also be adopted when a tower is made entirely of supple conduits as in the case of FIGS. 1 and 2.

In the example of FIGS. 3 to 5, the mast 44 is outside the tower 42, and bears at its top part a support 45 presenting, along axis 43, a suspension member 70 similar to members 10 and 11, which defines a vertical suspension axis coinciding with the axis 43.

The mast 44 advantageously rests on the ground 12 via a swivel joint 47, and is maintained in the desired position by stays such as 48 connecting its top zones to tie-rods such as 49 anchored in the ground; it will be noted that such stays may also be provided in the case of a central mast such as the mast 7 of FIG. 1.

According to the invention, conduit 41 presents a vertical supple wall 42 of axis 43, fast on its upper periphery with an upper hoop 50 and on its lower periphery, with a lower hoop 51, these two hoops 50 and 51 having, in the example illustrated, the identical shape of a regular polygon with 16 sides, disposed horizontally and centred on axis 43.

Apices of the hoop 50, diametrically opposite with respect to the axis 43, are connected by ties such as 52 deviated and carried, half-way between their ends, by the member 70 designed to allow their horizontal clearance freely whilst immobilising them vertically; each apex of the lower hoop 51 and, preferably, also of the upper hoop 50, is furthermore connected to the ground by a set of two stays, such as 53–54 and 55-56 respectively, the two stays of each set preferably being located in the same vertical plane tangential to the escribed circle of the corresponding hoop, and oriented along generatrices of a hyperbolid of revolution about the axis 43 of which the circle escribed with respect to the corresponding hoop constitutes a cross section.

At ground level, the stays are fixed to tie rods such as 57 and 58, anchored in the ground, preferably in a ring 59 centred on axis 43.

In the example illustrated, where the stays 53 and 54 on the one hand, 55 and 56 on the other hand, are connected to two vertically superposed apices respectively of the hoop 50 and of the hoop 51, the stays 53 and 55 are anchored to the same tie rod 57, and stays 54 and 56 to the same tie rod 58.

The connection between the lower periphery of the conduit 41 and the upper periphery 60 of the tower 42 is effected so as to allow a free horizontal clearance of the hoop 51 with respect to the tower 42 and, to this end, the lower periphery of the conduit 42 is for example given a shape and inner dimensions such that said conduit may be fitted around a zone of the tower 42 located in the immediate vicinity of its crown 60, with a sufficient horizontal clearance; in the example illustrated, where the tower 42 is in the form of a hyperboloid of revolution about axis 43, the dimensions of the hoop 51 are chosen such that the cylinder inscribed in the lower part of the wall 42 has a diameter greater than that of the crown 60 of the tower 42.

An ample, supple seal may advantageously be provided between the crown 60 of the tower and the lower part of the conduit 41, this supple seal being for example received, at the level of the crown 60 of the tower 42, by a rigid ring sealed thereon; it will be noted that this connection, which has not been shown, is optional.

It will be noted that, although a central suspension mast may in this case be used, as in the case of FIGS. 1 and 2, the use of an outer mast, as illustrated, enables, in this case, the extension to be installed without interrupting operation of the existing tower 42.

What is claimed is:

1. A stack or vertical pipe for the flow of gas, such as an atmospheric cooling tower, said stack or vertical pipe comprising:

a suspension mast defining a vertical suspension axis, a plurality of supple surfaces, open downwardly and upwardly, symmetrical with respect to this vertical axis, superposed vertically, a rigid, substantially horizontal upper hoop fast with the upper periphery of each surface, a rigid, substantially horizontal lower hoop fast with the lower periphery of this surface, each hoop being symmetrical with respect to said vertical axis, supple bearing ties suspending each upper hoop from the mast, the lower hoop of an upper supple surface is adjacent to but independent of the upper hoop of a supple surface located immediately therebeneath, these two hoops having similar shapes and dimensions in a horizontal plane, the lower hoops are not provided with bearing ties for suspension from the mast, the adjacent upper and lower hoops are adapted to undergo relative movements, and stays for connecting each lower hoop to one or more points fixed with respect to the ground, said points located at a level lower than that of said hoop to which the respective stays are connected, to stretch each supple surface between the corresponding upper and lower hoops, independently of the other supple surfaces.

2. The stack or pipe of claim 1, wherein each of said supple bearing ties connects two diametrically opposite zones of the corresponding hoop, and further comprising bearing means to suspend said each of said bearing ties from the mast between these two zones said bearing means guiding said bearing tie in movement coaxial with the bearing tie while preventing vertical movement of said bearing tie.

3. The stack or pipe of claim 1, wherein said fixed points are located on the ground.

4. The stack or pipe of claim 1, further comprising stays connecting at least one upper hoop to the ground.

5. The stack or pipe of claim 4, wherein the stays are disposed so as to oppose a rotation of the corresponding hoop above the vertical suspension axis.

6. The stack or pipe of claim 5, wherein the stays connecting a hoop to the ground are located in vertical planes tangential thereto or tangential to a circle circumscribed thereto, along straight lines of a vertical hyperboloid of which the hoop or the circle circumscribed thereto constitutes a horizontal plane section.

7. The stack or pipe of claim 3, wherein the stays are disposed so as to oppose a rotation of the corresponding hoop about the vertical suspension axis.

8. The stack or pipe of claim 7, wherein the stays connecting a hoop to the ground are located in vertical planes tangential thereto or tangential to a circle circumscribed thereto, along straight lines of a vertical hyperboloid of which the hoop or the circle circumscribed thereto constitutes a horizontal plane section.

9. The stack or pipe of claim 3, further comprising anchoring blocks disposed on the ground around at least one ring centered on said vertical axis and wherein the stays connecting a hoop to the ground are anchored to the ground by attachment to said blocks .

10. The stack or pipe of claim 9, further comprising tie-rods anchored in the ground and associated with the anchoring blocks.

11. The stack or pipe of claim 1, wherein the mast is outside said supple surfaces, and carries above said surfaces a support defining said vertical axis and bearing the bearing ties.

12. The stack or pipe of claim 1, wherein the mast is vertical, disposed along said vertical axis and coaxial with the axis of the supple surfaces, and bears said bearing ties directly.

13. The stack or pipe of claim 12, wherein said stays connect each lower hoop to a fixed point of the mast, located at a level lower than that of said hoop.

14. The stack or pipe of claim 1, wherein the lowermost supple surface presents an upwardly converging form and the lower hoop of this lower surface presents dimensions in horizontal plan greater than those of its upper hoop.

15. The stack or pipe of claim 1, wherein two supple surfaces are connected, at the level of their adjacent upper and lower peripheries respectively, by an ample, supple seal or joint allowing a relative movement of the corresponding hoops.

16. The stack or pipe of claim 1, further comprising means for preventing relative rotation of two adjacent upper or lower hoops.

17. The stack or pipe of claim 1, wherein said stack or pipe is superposed above a rigid stack or pipe having a crown.

18. The stack or pipe of claim 17, wherein the lower hoop is mounted with clearance with respect to the crown of the rigid pipe.

19. The stack or pipe of claim 18, wherein the lower hoop is connected to the crown of pipe by a supple joint allowing clearance of this lower hoop with respect to this crown.

20. The stack or pipe of claim 1, wherein the surface is constituted by a plurality of bands assembled along a generatrix and of which each presents an edge connected to the upper hoop and an edge connected to the lower hoop.

21. The stack or pipe of claim 1, wherein the assembly of the supple surfaces and their connection to the hoops is ensured by lacing.

* * * * *